US005386702A

United States Patent [19]

Wiesen

[11] Patent Number: 5,386,702

[45] Date of Patent: Feb. 7, 1995

[54] NOISE INHIBITING ARRANGEMENTS FOR ROOM AIR-CONDITIONERS

[76] Inventor: Bernard Wiesen, 15 Beach Rd., Great Neck, N.Y. 11023

[21] Appl. No.: 74,912

[22] Filed: Jun. 10, 1993

[51] Int. Cl.[6] ..... F24F 13/08; E04B 1/84

[52] U.S. Cl. ..... 62/262; 62/296; 454/906; 181/198; 181/205

[58] Field of Search ..... 62/296, 262; 181/198-200, 205; 454/906

[56] References Cited

U.S. PATENT DOCUMENTS

| | | | |
|---|---|---|---|
| 2,705,990 | 4/1955 | Miller | 62/262 |
| 2,711,769 | 6/1955 | Katcher et al. | 62/262 |
| 2,720,236 | 10/1955 | Hoffman | 62/262 |
| 2,901,989 | 9/1959 | Mondi | 62/262 |
| 3,011,424 | 12/1961 | Kohnen | 62/262 |
| 4,387,786 | 6/1983 | Klipsch et al. | 181/150 |
| 4,463,049 | 7/1984 | Kracke | 428/281 |
| 4,887,399 | 12/1989 | Berger et al. | 52/27 |

FOREIGN PATENT DOCUMENTS

| | | | |
|---|---|---|---|
| 2176335 | 7/1990 | Japan | 454/906 |

*Primary Examiner*—Henry A. Bennet
*Assistant Examiner*—William C. Doerrler

[57] ABSTRACT

Synthetic sponge or other resilient material is joined to the top of a room air-conditioner to absorb the physical impact of rain and dripping water to inhibit the creation of the noise that would otherwise occur. Additionally, a buffer formed with angular surfaces, to absorb and deflect the full impact of rain and dripping water to inhibit the creation of noise that would otherwise occur.

3 Claims, 1 Drawing Sheet

NOISE INHIBITING ARRANGEMENTS FOR ROOM AIR-CONDITIONERS

BACKGROUND-FIELD OF INVENTION

This invention relates to room air-conditioning units and specifically to the use of a resilient material used to absorb the impact of rain and dripping water to eliminate the drumming and splashing noise that would otherwise occur.

A further embodiment of the invention benefits from the use of angular surfaces to buffer the force of falling rain and dripping water.

BACKGROUND-DESCRIPTION OF PRIOR ART

During the past several decades, the manufacturers of window and through the wall air-conditioning units have developed an infuriating torture by designing cabinets for these devices that produce an echoing and annoying drum beat at the first appearance of rain, melting ice and snow or the dripping of water from above.

While much credit must be given to the manufacturers for the development of these devices, (and some attempts to silence the internal machinery have been made) but in their zeal to produce a lightweight and inexpensive cabinet for these devices, they have created an irritating beating drum, that has been responsible for many sleepless nights, as well as disturbing the thoughts and attention of their unhappy and angry owners.

Attempts to shield these disturbing noises by placing sound absorbing material inside the cabinet fail to properly solve this problem. The pounding and splashing noise that is produced on the outside of the cabinet simply passes through the wall or window the unit is placed through.

OBJECTS AND ADVANTAGES

This invention has as its salient object to improve a package air-conditioning unit that brings peace and harmony into the lives of the users of the aforementioned devices.

In addition, the commercial attractiveness of these devices would be greatly enhanced by the addition of this important unique feature.

The portion of the unit covered with the impact absorbing material could be enclosed by a removable cellophane band that could be printed with information to highlight this new feature. This feature could be named on the removable band with the addition of art work illustrating water drops falling at an angle toward its surface, calling attention to the fact that the manufacturer considers the comfort of his customer an important concern.

The present invention succeeds because the resilient material on top of the cabinet absorbs the physical impact of the rain and water drops, cushioning and damping the shock that would otherwise translate into a drumbeat against the surface of the cabinet.

A further embodiment of the invention presents angular surfaces facing the outside elements that buffer the full force of the impacting drops by deflecting them from direct contact with the cabinet surface.

DESCRIPTION

Figure 1:
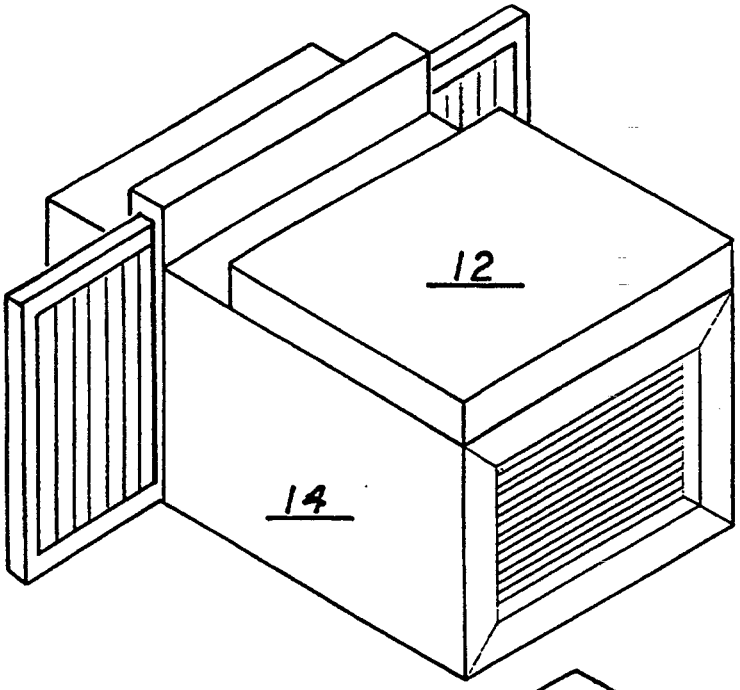
FIG. 1 is a perspective representation of a window air-conditioning unit.

In FIG. 1, resilient material 12 preferably formed from synthetic sponge is joined to the top of a room air-conditioner 14 by appropriate means (not shown).

Figure 2:
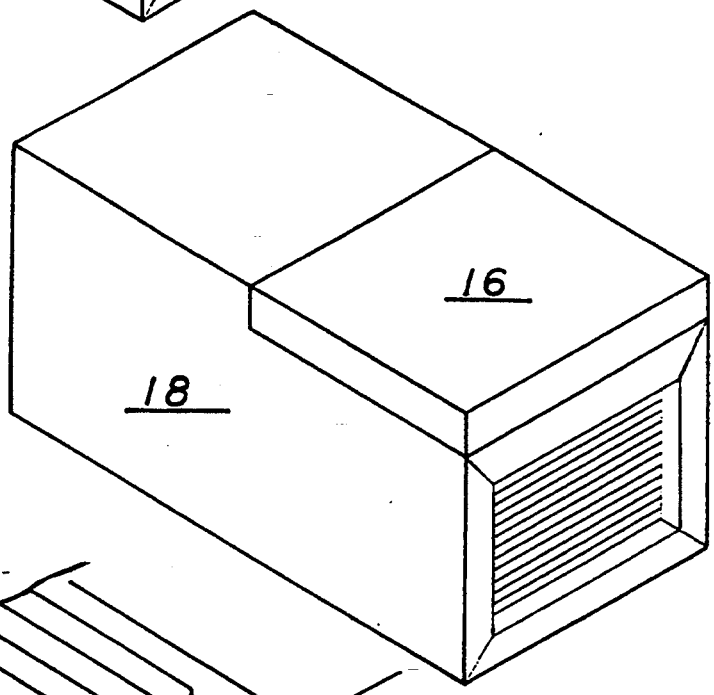
FIG. 2 is a perspective representation of a through the wall air-conditioning unit.

In FIG. 2, in this embodiment of the invention the resilient material 16 is joined to a through the wall type air-conditioner 18 by appropriate means (not shown) with the option of recessing the resilient material 16 for easy insertion into a wall sleeve (not shown).

Figure 3:
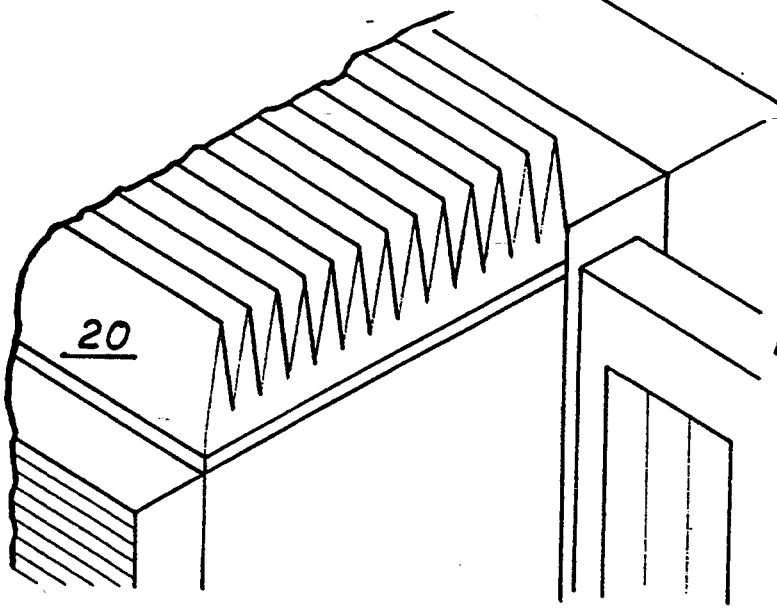
FIG. 3 is a perspective representation of a buffer whose top surface is composed of angular surfaces.

In FIG. 3 a buffer 20 which may be formed from a resilient material, because of its definition, more rigid substances may be successfully employed. Sheet-metal that has been formed with a corrugated shape that exposes very sharp angles toward the elements is another form the invention may take.

Although the above description contains few specificities, this should not be construed as limiting the scope of the invention. For example it should be apparent that this invention is not and should not be considered limited to its use as a noise preventive for window and through the wall air-conditioning units. Any cabinet or surface exposed to the outdoors that would produce unwanted noise caused by rain or dripping water would benefit from the advantageous features of this invention. The materials disclosed in this invention can be packaged in kit form and sold with appropriate material to join them to the top of an already manufactured room air-conditioner.

Thus the scope of the invention should be determined by the appended claims and their legal equivalents, rather than by the examples given.

The embodiments of the invention in which an exclusive property or privilege is claimed are defined as follows:

I claim:

1. Synthetic sponge to absorb the physical impact of rain drops and dripping water:

A method to absorb the physical impact of rain drops and dripping water comprising synthetic sponge joined with the upper surface of an air conditioning cabinet to inhibit the creation of the noise that would otherwise occur.

2. An air-conditioning unit disposed within a building with a portion of said air-conditioning unit disposed outside the building comprising a spongy soft body used as a cushion to reduce and absorb the shock of rain and falling water to inhibit the noise that would otherwise occur.

3. An air-conditioning unit according to claim 2 wherein said spongy soft body is formed with angular surfaces to further deflect the force of falling rain or dripping water.

* * * * *